US005657593A

United States Patent [19]

Eriksen

[11] Patent Number: 5,657,593

[45] Date of Patent: Aug. 19, 1997

[54] MOUNTING BRACKET AND MOUNTING SYSTEM

[76] Inventor: Bernt Eriksen, Fiolsvingen 7, N-3050 Mjøndalen, Norway

[21] Appl. No.: 295,731

[22] PCT Filed: Mar. 9, 1993

[86] PCT No.: PCT/NO93/00035

§ 371 Date: Aug. 25, 1994

§ 102(e) Date: Aug. 25, 1994

[87] PCT Pub. No.: WO93/18248

PCT Pub. Date: Sep. 16, 1993

[30] Foreign Application Priority Data

Mar. 9, 1992 [NO] Norway ..... 920925

[51] Int. Cl.[6] ..... E04B 2/96; E04F 13/08

[52] U.S. Cl. ..... 52/235; 52/506.06; 52/506.08; 52/512; 52/713; 52/745.1; 248/300

[58] Field of Search ..... 52/235, 506.06, 52/506.08, 506.09, 508, 512, 513, 698, 713, 714, 715, 745.1, 745.13; 248/300

[56] References Cited

U.S. PATENT DOCUMENTS

| | | | |
|---|---|---|---|
| 581,940 | 5/1897 | Pelton | 52/426 X |
| 1,052,670 | 2/1913 | Francis | 52/714 X |
| 1,854,633 | 4/1932 | Stephens | 52/713 X |
| 3,110,131 | 11/1963 | Jeffress | 52/235 X |
| 3,113,358 | 12/1963 | Zell et al. | 403/231 X |
| 3,350,830 | 11/1967 | Smith, Jr. et al. | 52/509 |
| 3,490,797 | 1/1970 | Platte | 403/231 X |
| 3,640,043 | 2/1972 | Querfeld et al. | 52/235 X |
| 3,786,605 | 1/1974 | Winfrey | 52/235 |
| 3,888,055 | 6/1975 | Gallo | 52/235 X |
| 3,914,914 | 10/1975 | Jureit et al. | 52/715 X |
| 4,070,835 | 1/1978 | Revèrend et al. | 52/506.08 X |
| 4,107,887 | 8/1978 | Wendt | 52/235 X |
| 4,261,593 | 4/1981 | Yeager | 403/262 X |
| 4,307,551 | 12/1981 | Crandall | 52/235 |
| 4,360,993 | 11/1982 | Tomokazu et al. | 52/508 X |
| 4,570,400 | 2/1986 | Slager et al. | 52/235 |
| 4,720,952 | 1/1988 | Fricker | 52/713 X |
| 4,782,635 | 11/1988 | Hegle | 52/235 X |
| 4,811,537 | 3/1989 | D'Epenoux | 52/235 X |
| 4,918,893 | 4/1990 | Vandenbroucke et al. | 52/712 X |
| 4,949,929 | 8/1990 | Kesselman et al. | 248/300 |
| 5,063,718 | 11/1991 | Nonis | 52/235 |
| 5,111,632 | 5/1992 | Turner | 52/713 X |
| 5,265,396 | 11/1993 | Amimoto | 52/235 X |
| 5,313,760 | 5/1994 | Tojo | 52/513 X |
| 5,335,469 | 8/1994 | Stuart | 52/713 X |

FOREIGN PATENT DOCUMENTS

| | | | |
|---|---|---|---|
| 082353 | 6/1983 | European Pat. Off. . | |
| 483673 | 5/1992 | European Pat. Off. . | |
| 1181986 | 6/1959 | France | 52/506.08 |
| 3611072 | 10/1987 | Germany . | |
| 4-360948 | 12/1992 | Japan | 52/506.06 |
| 4-366270 | 12/1992 | Japan | 52/506.06 |
| 6-108570 | 4/1994 | Japan | 52/235 |
| 8600044 | 5/1986 | Netherlands | 52/506.06 |
| 526291 | 9/1940 | United Kingdom | 52/506.06 |
| 1300059 | 12/1972 | United Kingdom | 52/486 |
| 2224327 | 5/1990 | United Kingdom | 403/406.1 |
| WO91/19056 | 12/1991 | WIPO | 52/506.05 |

*Primary Examiner*—Carl D. Friedman
*Assistant Examiner*—Laura A. Saladino
*Attorney, Agent, or Firm*—Rodman & Rodman

[57] ABSTRACT

A fixture for mounting external cladding in the form of single facing sheets on internal or external walls of buildings includes a fixing bracket for affixation to a wall and a horizontal positioning plate to support the external cladding sheet. The horizontal positioning plate includes guides which hold the facing sheet in place. The fixture is horizontally and vertically adjustable. The horizontal positioning plate and the fixing bracket have substantially horizontal support surfaces that engage each other and are horizontally adjustable in all directions relative to one another. The horizontal supporting plate is locked in a selected position to the fixing bracket by a welded connection after the horizontal positioning plate has been adjusted relative to the fixing bracket.

11 Claims, 2 Drawing Sheets

MOUNTING BRACKET AND MOUNTING SYSTEM

Figure 1:
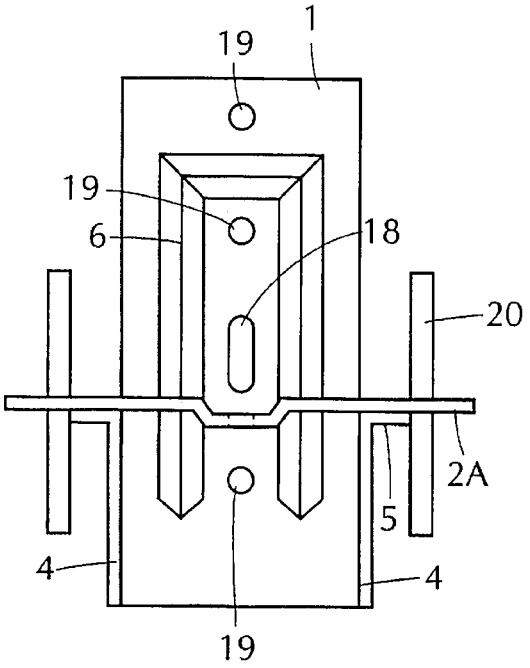

The present invention relates to a method of mounting external cladding in the form of single sheets on, for example, the walls of buildings, by using fixtures which prior to the final mounting consist of at least two main segments, a wall bracket and a horizontal positioning plate, and also guides which hold the actual facing sheets in place. The invention also relates to the actual fixture.

The invention has been especially developed for mounting and fixing heavier types of external cladding, eg. natural stone. The fixtures can be mounted on all kinds of bases, such as steel, plaster, concrete and wood. The invention can be used both during the construction of new buildings and during the rehabilitation of existing buildings.

Today various methods are used for fixing external cladding consisting of, for instance, natural stone. A common feature of most of these methods is, according to persons versed in the art, that they are time-consuming. This is due, in the main, to the fact that it is often necessary to align the wall body and it is difficult to put the brackets in the right position on the wall. It is usual to use a guide pin which is passed through the bracket and into the facing stone in order to hold said facing stone in place. Because of inaccurate positioning of the brackets, it is common to drill guide pin holes in the facing stone whilst at work in the scaffolding after distance measurements or position measurements have been taken. This requires adjustment work stone by stone. This is both time consuming and expensive. There are various types of rail systems, but a common feature of these is that they are extremely expensive. In some cases the plates are attached above/below the facing stone, and in other cases they are attached along the sides. This is dependent upon the design of the plates.

EP-A-0208229 discloses a fixing bracket designed for external cladding in the form of artificial or natural stone. This bracket is not adjustable in height so that when the fixing screws are mounted in the bearing wall, the height position of the bracket will be fixed. The horizontal segment of the bracket can however be adjusted normal on the wall by means of slots, whilst it can be adjusted parallel to the wall by means of yet another slot. The bracket is thus adjustable in two dimensions.

DE Auslegesschrift 1289289 also discloses a wall bracket for external cladding. The segment which supports the facing sheet is adjustable to a certain extent relative to the wall. This segment is also height adjustable, but the height adjustment is dependent upon the adjustment in the horizontal plane in a direction along the wall.

DE Offenlegungschrift 3611072 also teaches a fixture for external cladding. One embodiment is not height adjustable. It can however be adjusted in the horizontal plane both along the wall and at right angles to the wall, although the last-mentioned is done by means of teeth which do it step by step and not continuously. A second embodiment is height adjustable by means of a slot. In this case, the distance to the wall can also be adjusted step by step and the adjustment along the wall is carried out by means of a slot, but a support plate describes a circular arc on adjustment of this kind. With a fixture of this kind the guide pins will easily come out of linear alignment with other pins on corresponding brackets when an adjustment of this kind is carried out.

DE Offenlegungschrift 3910286 teaches yet another fixing bracket for external cladding. It is height adjustable via a slot in a plate. The actual support portion of the bracket is not adjustable in the direction that is at right angles to the wall or along the wall in the horizontal plane.

The brackets referred to above according to the state of the art are designed for use with the traditional method of fixing external cladding. I.e., that the brackets are mounted in succession as the facing sheets are mounted in place one by one.

That which especially characterizes the present method and fixture is that the mounting of the external cladding is prepared section by section so that a whole facing section is completed before work is started on the next section. If the building is small the external cladding can be mounted as a single section. The new fixture is especially designed for this sectional mounting of external cladding for which the previously known fixtures were not particularly well-suited.

With the method and the fixture according to the invention, an extremely accurate positioning of the fixture is achieved in a simple manner. It makes it possible to drill guide pin holes in the facing sheet/stone in the factory. This gives rise to great savings with regard to time and costs.

Furthermore, the fixture consists of two segments: a fixing bracket designed to be fixed to the wall and a horizontal positioning plate. The fixing bracket is used as a base for several kinds of positioning plates. This makes the fixture flexible with regard to the dimensions of the facing sheets. Moreover, the positioning plates can be aligned and positioned by means of a specially constructed straightedge which extends across several fixtures. The method and the fixture provide therefore an extremely user-friendly system in terms of mounting and adjustment. Furthermore, the actual locking of the positioning plate to the support bracket, by means of screw connections or welding, is simple because they have surface contact with one another. The positioning plate can be used on all four edges of the facing sheet/stone if the right plate is selected. Moreover, the possibility of adjusting the facing sheet/stone laterally is further increased in that a slit is cut or milled in the upper and lower edges of the sheet/stone. The support bracket also has great support capabilities (important when mounting on plaster), is low in weight and is simple to produce.

In accordance with the present invention, a method is provided that is of the kind mentioned by way of introduction which is characterized in that the building wall is marked in its entirety or section by section with horizontal and vertical modular dimensions or separation distance measurements for the rough positioning of the fixing brackets. The fixing brackets are then roughly mounted on to the building wall, the outer fixing brackets on each side of the section are thereafter defined definitively and are height adjusted to the correct height and are locked in this position. A suitable tool, such as a straightedge, is used to height adjust the intermediate support brackets to the right height. The brackets are then locked in this position. Thereafter the positioning plates are secured temporarily to the brackets on each side in the section and are finely adjusted in the horizontal plane until they are at the right distance from the wall and the separation distance between the facing sheets is correct and they are locked thereafter in this position. A suitable tool, such as a straightedge, is used to position the intermediate positioning plates on the fixing brackets at the correct distance from the wall and at the correct separation distance and locks these to one another in the final position, the facing sheets being mounted from below and upwards.

It would be of advantage if all the fixing brackets in a defined section could be roughly mounted prior to the start of the fine adjustment and mounting of the facing sheets. Optionally, the support brackets necessary for one row of facing sheets only could be roughly mounted and finely adjusted before the mounting of the facing sheets, and prior to the mounting of the next row of fixing brackets and facing sheets.

It would be expedient to roughly mount the fixing brackets by means of a fixing screw through a slot made in the fixing bracket, said slot allowing said height adjustment. It would be expedient to lock the positioning plates to the fixing brackets by means of screw connections or welding.

According to the present invention, a fixture is also provided for mounting external cladding in the form of single sheets on, for example, building walls, said fixture comprising two main segments, a fixing bracket designed for being fixed to the wall and a horizontal positioning plate designed to support the facing sheet, and also guides which hold the facing sheet in place, said fixture being horizontally and vertically adjustable, characterized in that the positioning plate and the fixing bracket have substantially horizontal supporting surfaces which lie true against one another and are horizontally adjustable in relation to one another, said plate being definitively locked to the fixing bracket by means of screw connections or welding after it has been adjusted relative to the bracket.

The fixing bracket can be height adjustable by means of a vertically extending slot. The supporting surfaces of the fixing bracket can be in the form of supporting wings which are substantially at right angles to the vertically extending supporting portions. The positioning plate may have a stamped strength profile in the centre. The positioning plate may also have a plurality of stamped-out holes for the alternative positioning of the guides. The positioning plate may have a strong upwardly pressed back which projects further than the rest of the plate and has in the end thereof stamped-out holes for the guide, said positioning plate being designed for lateral mounting (vertical mounting). The positioning plate may have two angular projections which extend in the upwards direction and two in the downwards direction, these being designed to engage with a slot that is milled/cut in the upper and lower edges of the facing sheet.

Figure 3:
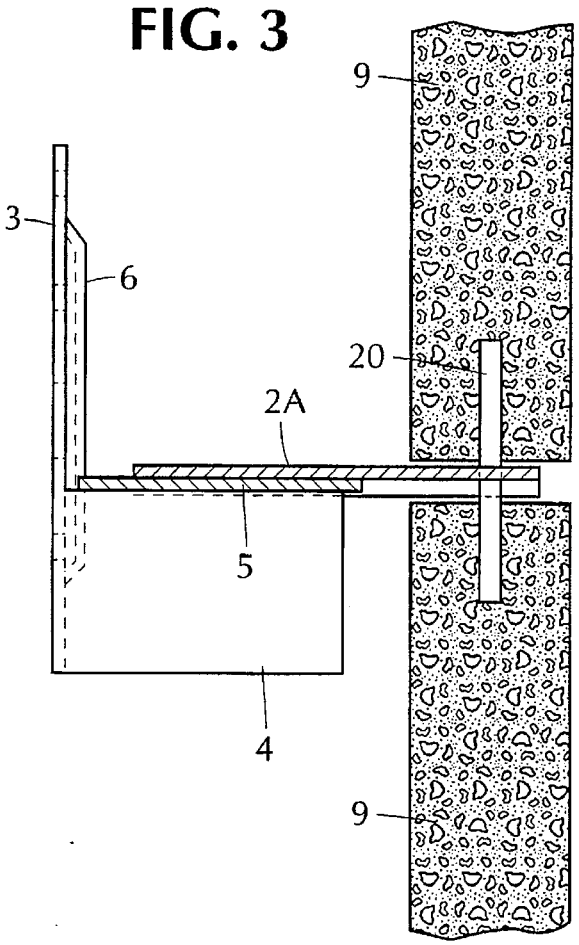
Figure 2:
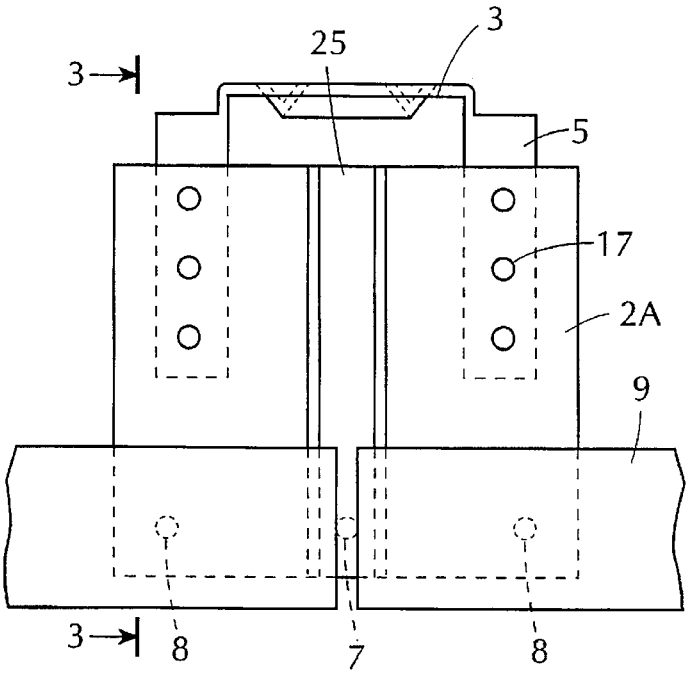
Figure 4:
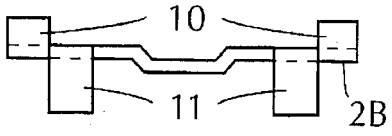
Figure 6:
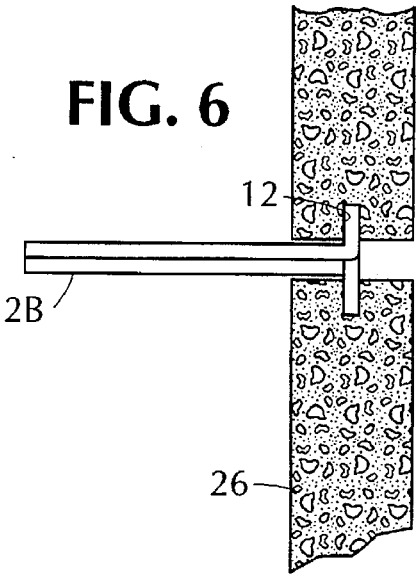
Figure 5:
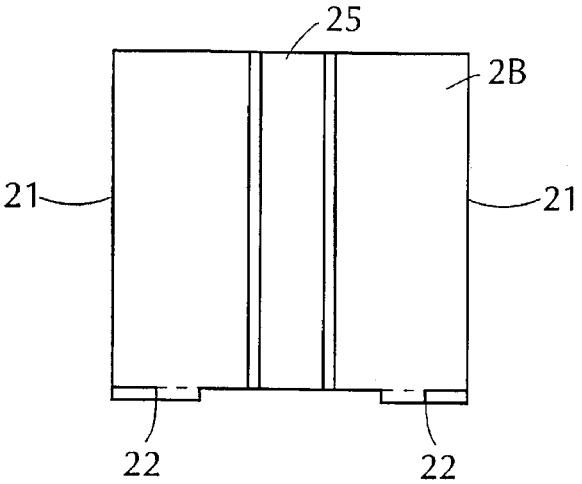
Figure 8:
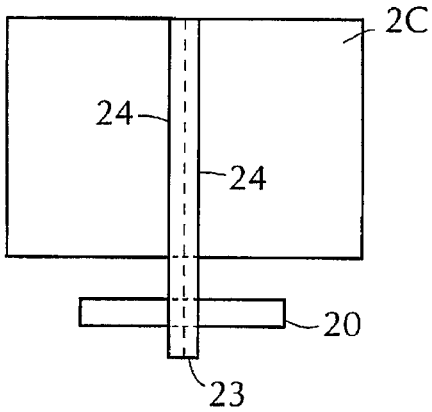
Figure 7:
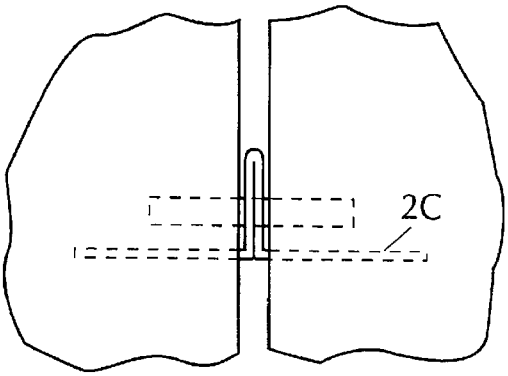
Figure 9:
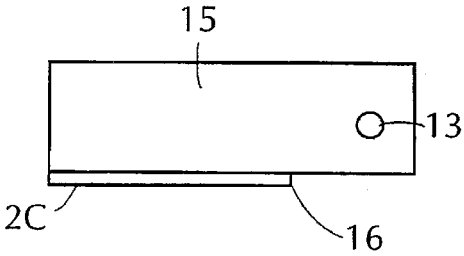

Other and additional objectives, features and advantages will become clear from the following description of the embodiment that is at present preferred, as is given for the purposes of description, without thereby being limitative, and which is given in connection with the drawings attached hereto wherein:

FIG. 1 illustrates schematically the fixture according to the invention seen from straight ahead and prior to the mounting of a facing sheet, FIG. 2 shows schematically the fixture according to FIG. 1 seen from above with the external cladding mounted, FIG. 3 shows a sectional outline from the side through the fixture and mounted external cladding, FIG. 4 is a schematic illustration of an alternative embodiment of the positioning plate seen from above, FIG. 5 illustrates the positioning plate according to FIG. 4 seen from above, and FIG. 6 shows the positioning plate according to FIGS. 4 and 5 seen from the side with the external cladding mounted, FIG. 7 is a schematic illustration of yet another alternative embodiment of the positioning plate seen from in front and with the external cladding mounted, FIG. 8 shows the positioning plate according to FIG. 7 seen from above, and FIG. 9 shows the positioning plate according to FIGS. 7 and 8 seen from the side.

Reference is first made to FIGS. 1 to 3 which illustrate a first embodiment of the fixture. The fixture consists of a fixing bracket 1 which is designed to be fixed to the wall, and a horizontal positioning plate 2A which is designed to support the actual facing sheet 9. The positioning plate 2A also has guides 20 which are to hold the facing sheets 9 in place. The fixing bracket and the positioning plate can each individually consist in their entirety of a single sheet. These can be cut and bent from a sheet profile by means of a specially made tool. Both the fixing bracket 1 and the positioning plate 2A can be made of different kinds of sheet material. Stainless steel is the most suitable material. Both fixture segments can alternatively be dead mould cast in a suitable material. The fixing bracket 1 is formed in the shape of a U where the bottom 3 is designed to lie adjacent to the bearing wall and the lateral surfaces 4 project at right angles from the bottom 3 and form supporting walls. On the top of the side walls 4 a horizontal plate 5 extends outwardly to each side in the form of supporting wings. The bottom or the back 3 of the fixing bracket 1 projects somewhat higher than said supporting wings 5. This is to reduce the extraction forces of the fixing screws. The back 3 has profiles 6 in order to attain greater strength. The fixing bracket 1 is manufactured with holes 18,19 for fixing to the wall. During the first rough mounting, the fixing bracket 1 is secured to the bearing wall through the elongate hole 18 which allows for height adjustment. The other holes 19 are used for the definitive fixing to the bearing wall.

The fixing bracket 1 forms the base for the positioning plate 2 which can be of various designs. Three different embodiments of the positioning plate 2 are described hereinbelow. The first embodiment is illustrated in FIGS. 1 to 3. The positioning plate 2A has one or two guide pins 20 (twin) in the outer part of the plate. Three holes 7–8 have been punched out in the plate for the alternative positioning of the guide pin 20 in the external cladding 9. The positioning plate 2A can be screwed or welded to the fixing bracket 1 after their position relative to one another has been determined.

FIGS. 4 to 6 illustrate an alternative embodiment of the positioning plate 2B. The fixing bracket 1 can be the same as in the previous embodiment. The positioning plate 2B is designed for horizontal fixing with fixing angular projections 10 and 11 instead of the guide pins 20. The positioning plate 2B can be cut and bent at the end so that two pieces of the plate extend upwards 10 and two extend downwards 11. A correspondingly wide slot 12 can then be milled in the end surface of the external cladding. The plates 2A and 2B are substantially rectangular and a feature common to them both is that they have a depressed profile 25 in the central area to increase strength and stability. By using guide pin hole 8, the bracket 1 (twin bracket) is and can be placed in a cross-junction where each of the positioning plates 2A and 2B fix/position four adjacent corners of external cladding.

FIGS. 7 to 9 depict yet another embodiment of the positioning plate 2C which can be used together with the previous fixing bracket. The positioning plate 2C is used for vertical fixing with guide pin 20. The positioning plate 2C is rectangular and has a strong upwardly pressed back 15 which is extended across the edges 16 of the plate 2C. A hole 13 through which the guide pin 20 is to be fed is punched out outermost along the back 15

It should be understood that the fixture according to the invention is delivered to the building site in two parts. To start the mounting process the modular walls are marked off on the existing wall. Both the horizontal and vertical modular dimensions for the fixing bracket 1 are marked off on the wall. The fixing brackets 1 are roughly mounted at the points where the vertical and horizontal modular dimensions cross in a suitably large section by means of a fixing screw which is passed through the elongate slot 18 and into the existing wall. Thereafter the outer fixing brackets 1 are finely adjusted to the correct height on each side of the section. Thereafter a straightedge (not shown) is put in position and the intermediate fixing brackets 1 are adjusted to the correct height position and all said intermediate fixing brackets 1 are fixed to the existing wall and are fixed definitively by means of a plurality of fixing screws which are passed through the additional screw holes 19 in the fixing brackets 1. At this point all the fixing brackets are fixed in a secure manner to the existing wall and at the right height. Thereafter, positioning plates 2A,2B,2C are secured temporarily by means of clamps to the supporting wings 5 of the fixing brackets 1 on each side of the section and are finely adjusted in the horizontal plane and are, for example, spot welded with a spot welding iron or locked by means of screw connections at points 17 which are shown on FIG. 2. Thereafter, the intermediate positioning plates 2A, 2B and 2C can be put into place and they can be aligned by means of a specially made straightedge (not shown) on which are mounted replaceable brackets that are adjustable relative to one another with pins which fit in the guide pin holes 7 and 8 and which position the positioning plates 2A. In order to align the positioning plates 2B and 2C, positioning brackets are mounted on the special straightedge which lies adjacent to the edges 21,22 and 23,24. After the fine alignment the positioning plates 2A, 2B and 2C are locked on to the supporting wings 5 as described hereinabove. The outermost bracket 1 and positioning plate 2 are used as the starting point for the next section and work their way thus section by section, from below and upwards until the facing has been completed.

What is claimed is:

1. A method of mounting external facing on an inside or outside wall of a building structure comprising, a) forming a fixture that includes, 1) a wall bracket with a vertical component that is attachable to a wall and a horizontal component that extends horizontally away from the vertical component, and providing at least one opening in the vertical component to permit vertical adjustment of the wall bracket on a wall, 2) a horizontal positioning plate adapted to be supported on the horizontal component by substantially planar surface-to-surface contact between the horizontal positioning plate and the horizontal component to permit horizontal adjustment of the horizontal positioning plate relative to the horizontal component in any direction for any selected amount of movement and the horizontal positioning plate having guides that extend above and below the horizontal component for holding a facing sheet in a fixed position on the fixture, b) marking the wall in its entirety or section by section with horizontal and vertical modular dimensions or separation distance measurements for approximate positioning of the fixture on the wall, c) securing a plurality of the wall brackets to the wall in selected locations based on the markings made to the wall in a manner which permits vertical adjustment of the fixtures in their secured locations, d) locking the wall brackets to the wall after they have been adjusted to predetermined positions, e) temporarily securing the horizontal positioning plate of each fixture to a corresponding horizontal component of a respective said wall bracket, f) making a fine adjustment of the horizontal positioning plates on the corresponding horizontal components of the wall brackets by moving each of the horizontal positioning plates on their respective horizontal components in any direction for any selected amount of movement such that the horizontal positioning plates are located at predetermined distances from the wall and provide predetermined spacing between the facing sheets of each of the fixtures, g) locking the horizontal positioning plates in their fine adjustment position by using welding and only welding to secure the positioning plates to the corresponding horizontal components of the wall bracket, and h) mounting a facing sheet to the horizontal positioning plate of each fixture at the guides above and below the horizontal positioning plate.

2. The method of claim 1, including mounting the wall brackets in a predetermined section of the wall by approximate securement and when all of the wall brackets in the predetermined section are approximately secured to the wall, making a fine adjustment of the position of the wall brackets and then mounting the facing sheets to the horizontal positioning plate.

3. The method of claim 1, including mounting one row of wall brackets to the wall and then making fine adjustments of the wall brackets in the one row prior to mounting of the facing sheets to the horizontal positioning plates and thereafter mounting another row of wall brackets and facing sheets above or below the first row in the same manner as the first row of wall brackets and facing sheets were mounted and adjusted.

4. The method of claim 1, including forming the adjustment opening in the wall bracket as an elongated slit and passing a screw into the slit in the wall bracket to provide an approximate height adjustment of the wall bracket on the wall.

5. A fixture for mounting cladding in the form of facing sheets on wall structures, said fixture comprising, a) a wall bracket with a vertical component that is attachable to a wall and a horizontal component that extends horizontally away from the vertical component, the vertical component having at least one opening that permits vertical securement and adjustment of the fixture on a wall in a predetermined position, b) a horizontal positioning plate supported on the horizontal component and having guides for engagement with a facing sheet to hold a facing sheet in place, c) said horizontal positioning plate and said horizontal component of the wall bracket having substantially planar contacting surfaces that lie one against the other in surface-to-surface contact to permit horizontal adjustment of the horizontal positioning plate relative to the horizontal component in any direction for any selected amount of movement, d) said horizontal positioning plate and said horizontal component of the wall bracket being locked together by welding and only welding to provide a predetermined position of the horizontal positioning plate relative to the wall bracket after the wall bracket has been adjusted to its predetermined position on the wall.

6. The fixture as claimed in claim 5, wherein the vertical component of the wall bracket includes an elongated vertically extending slot to permit height adjustment of the wall bracket on the wall.

7. The fixture as claimed in claim 5, wherein the horizontal component of the wall bracket is in the form of spaced supporting wings that extend substantially perpendicularly away from the vertical component of the wall bracket.

8. The fixture as claimed in claim 5, wherein the vertical component of the wall bracket is stamped to provide a predetermined relief section that strengthens the vertical component of the wall bracket.

9. The fixture as claimed in claim 5, wherein the horizontal positioning plate has a plurality of openings to permit positioning of the guides in a predetermined position.

10. The fixture as claimed in claim 5, wherein said horizontal positioning plate has a first horizontal section and an upwardly pressed ridge section which projects upwardly from the first horizontal section and a hole at one end of the horizontal positioning plate for said guides to permit mounting of a facing sheet to the horizontal positioning plate.

11. The fixture as claimed in claim 5, wherein said horizontal positioning plate has a horizontal section and wherein said guides include two angular projections projecting upwardly from the horizontal section and two angular projections extending downwardly from the horizontal section for engagement in slots formed in a top and bottom edge of a facing sheet.

* * * * *